US005878676A

United States Patent [19]

Jochem et al.

[11] Patent Number: 5,878,676

[45] Date of Patent: Mar. 9, 1999

[54] BURNER AND FURNACE OPERATED WITH AT LEAST ONE BURNER

[75] Inventors: Matthias Jochem, Wipperfürth; Hans-Ulrich Thierbach, Wiehl, both of Germany

[73] Assignee: L. & C. Steinmüller GmbH, Gummersbach, Germany

[21] Appl. No.: 845,632

[22] Filed: Feb. 28, 1997

[30] Foreign Application Priority Data

Feb. 29, 1996 [DE] Germany ..... 196 07 676.5

[51] Int. Cl.[6] ..... F23K 3/02; F23L 17/16; F23M 9/00; F23C 5/06

[52] U.S. Cl. ..... 110/261; 110/260; 110/104 B; 110/262; 431/181; 431/186; 431/187; 431/188; 431/189

[58] Field of Search ..... 110/104 B, 260, 110/261, 262, 263, 264, 265, 347; 431/171, 181, 182, 183, 184, 185, 186, 187, 188, 189

[56] References Cited

U.S. PATENT DOCUMENTS

| | | | |
|---|---|---|---|
| 4,253,403 | 3/1981 | Vatsky | 110/104 B |
| 4,915,619 | 4/1990 | LaRue | 431/284 |
| 4,930,430 | 6/1990 | Allen et al. | 110/264 |
| 4,976,607 | 12/1990 | Grimard | 431/174 |
| 5,199,355 | 4/1993 | Larue | 110/261 |
| 5,649,819 | 7/1997 | Karzone | 431/174 |
| 5,738,021 | 4/1998 | Vatsky et al. | 110/163 |

FOREIGN PATENT DOCUMENTS

| | | |
|---|---|---|
| 343767 | 11/1989 | European Pat. Off. . |
| 445938 | 9/1991 | European Pat. Off. . |

*Primary Examiner*—Ira S. Lazarus
*Assistant Examiner*—Ljiljana V. Ciric
*Attorney, Agent, or Firm*—Robert W. Becker & Associates

[57] ABSTRACT

A burner is provided for a furnace having at least one windbox that is supplied with air for combustion and has extending therethrough at least one such burner, which opens out toward the combustion chamber. The burner has at least one primary air channel, which is supplied from the outside with a coal dust/air mixture, at least one secondary air channel, which surrounds the primary air channel, and at least one tertiary air channel, which surrounds the secondary air channel. The secondary and tertiary air channels can be supplied with air from the windbox in a regulated manner. Along a rotationally symmetrical portion of an outer surface of each of the secondary and tertiary air channels there is respectively provided at least one air inlet opening. Respective annular valve sections are rotatably disposed about one of the rotationally symmetrical portions of the secondary and tertiary air channels. These two annular valve sections each have at least one air passage opening, and are successively disposed one after the other as viewed in an axial direction of the burner.

10 Claims, 4 Drawing Sheets

20°
100°
33
28
28a
33b
33
33a
60°
28b
34b
20°
60°
35
60°
34a
34
28c
80°
40°
22d
23
23a
23
23a
18e
8a
20°
27a
27
27
27a
80°
8b
28c
18e
22d
28a
28b
8

BURNER AND FURNACE OPERATED WITH AT LEAST ONE BURNER

BACKGROUND OF THE INVENTION

The present invention relates to a burner for a furnace having at least one windbox that is supplied with air for combustion and has extending therethrough at least one such burner, which opens out toward a combustion chamber. At least one primary air channel is provided that is supplied from the outside with a coal dust/air mixture, and that is surrounded with at least one secondary air channel which in turn is surrounded by at least one tertiary air channel. Air can be supplied in a regulated manner from the windbox to the secondary and tertiary air channels.

A burner of this general type is known from EP 0 445 938 A1. With the known burner, a secondary resistor is associated with the input side of the secondary air channel. This secondary resistor comprises a side plate which is connected to the upstream end of the secondary air channel. Spaced at a distance from this plate is a further annular plate that surrounds the core air tube and is spaced from and disposed parallel to the plate that is connected to the free end of the secondary air channel. Rotatably mounted between the two plates are a plurality of flat individual vanes. The flat plates serve to establish the pressure loss by setting their angular position by means of a control unit and hence the establishment of a prescribed flow rate of secondary air into the secondary air channel. A corresponding arrangement is provided at the introduction end of the tertiary air channel.

This known arrangement requires a number of movable components, and does not permit a coupled adjustment of the air quantities being introduced from the windbox into the secondary and tertiary air channels.

It is therefore an object of the present invention to provide a burner of the aforementioned general type where it is easier to supply the secondary and tertiary air channels from the windbox.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
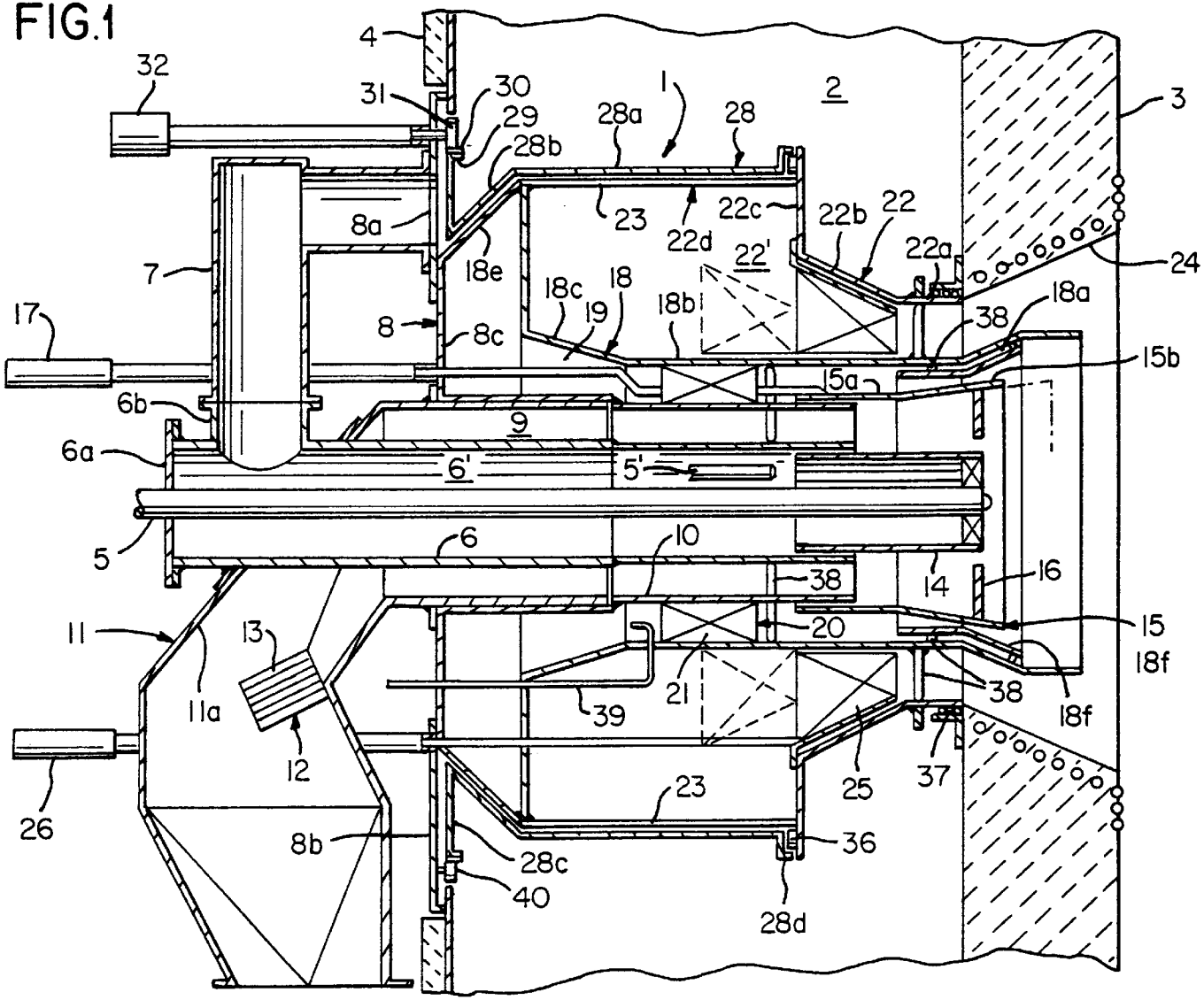
FIG. 1 is a cross-sectional view through one exemplary embodiment of the inventive burner, which is disposed in an air receiver or windbox.

The burner of the present invention is characterized primarily in that both the secondary air channel and the tertiary air channel, along a rotationally symmetrical portion of an outer surface thereof, are respectively provided with at least one air inlet opening, with a respective annular valve section, which has at least one air passage opening, being rotatably disposed on such portions of the secondary and tertiary air channels; the two annular valve sections for regulating the supply of air from the windbox to the secondary and tertiary air channels are successively disposed one after the other as viewed in an axial direction of the burner.

In this manner, a particularly easy way of supplying the two air channels with secondary and tertiary air is achieved.

Since the two annular valve sections are disposed one after the other, it is possible to rigidly interconnect them and to thus couple the supply of the two channels.

In this connection, it can be expedient to respectively offset the air inlet openings within the channel sections, and the air passage openings within the annular valve sections, from one another in the circumferential direction.

Burners are known where there is also provided in the primary air channel a core air channel in which an oil or gas lance is disposed. With such a burner, the core air channel can preferably be supplied from the windbox by means of a core air connecting channel that is disposed externally of the windbox.

The annular valve section for the tertiary air is preferably a straight cylindrical annular valve.

In order to limit the overall radial size of the burner, it is advantageous if the annular valve section for the secondary air be a frustoconical annular valve on that end of which that is remote from the tertiary air annular section there is disposed a plate-like control disk having an air passage opening for the passage of core air out of the windbox into the core air connection channel. Due to the conical tapering of the annular valve section for the secondary air, it is possible for the inlet opening into the core air supply channel to essentially still be disposed within the cylindrical surface provided by the tertiary air valve section.

The longitudinal edges of the air inlet openings in the secondary air channel and/or in the tertiary air channel are preferably disposed axially parallel, while at least one edge of the air passage openings in the associated annular valve sections is disposed at an angle to the burner axis. In this way, a smooth regulating behavior of the cooperation of the air passage openings and of the air inlet openings is achieved.

An axially displaceable flame holder comprising a straight cylindrical portion and adjoining this a conically widening portion is preferably disposed at the discharge end of the primary air channel; a blocking means is disposed at the discharge end of the conically widening portion.

Flame holders disposed at the discharge end of a primary air channel are known.

Disposed between the widening portion, which represents a primary air muffle, and the muffle-type discharge of the secondary air channel, is a radiation protection shield, the shape of which is adapted to the foregoing. The secondary air muffle is preferably S-shaped when viewed in a longitudinal cross-section.

An elbow preferably precedes the inlet of the primary air channel. A rope breaker is disposed within the elbow on that wall on which a coal dust rope is established, which coal dust rope is formed during deflection in the elbow.

The cross-sectional contour of the elbow when viewed in the direction of flow of the primary air is preferably such that a retardation of the flow occurs prior to the rope breaker.

The present invention is also directed to a furnace or boiler having at least one windbox that is supplied with air for combustion and that has extending therethrough at least one burner.

Further specific features of the present invention will be described in detail subsequently.

DESCRIPTION OF PREFERRED EMBODIMENT

With respect to FIG. 1, the burner 1 is introduced from the left into the air receiver or windbox 2 which in FIG. 1 is delimited toward the right by the combustion chamber wall 3, which is preferably a tubular wall, and is delimited toward the other side by a side wall 4 that is provided with insulation means. Although not illustrated, the windbox 2 is preferably supplied with preheated combustion air.

An oil ignition lance 5 with which is associated an electrical ignitor 5' is disposed along the longitudinal axis of the burner within a core air tube 6 that defines a core air channel 6'. The rear end of the core air tube 6 is closed off by a plate 6*a* through which extends the oil lance 5. Also disposed at the rear end of the core air tube is a lateral connector 6*b*, which is connected to a core air supply tube 7 that forms a right angle. In the vicinity of an air passage opening 8*a*, the core air supply tube 7 is secured to a multi-part burner mounting plate 8, which in turn is secured to the side wall 4 of the windbox 2. Accompanied by the formation of a cylindrical annular channel 9, the core air tube 6 is surrounded by a primary air tube 10.

Figure 2A:
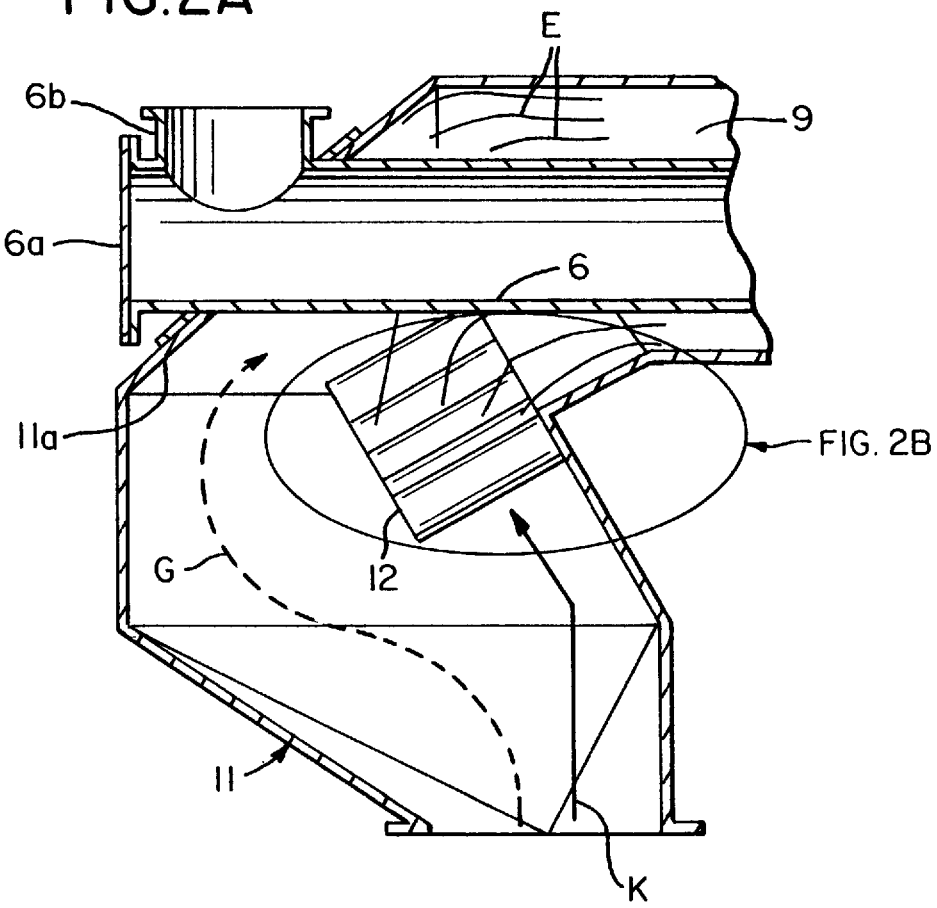
FIG. 2 is an enlarged cross-sectional view of part of the elbow of the burner.
Figure 2B:
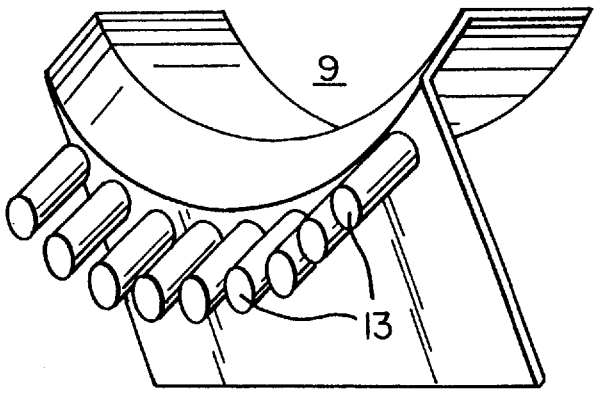

As will now be described, the core air tube 6 is supplied with a coal dust/gas mixture. The coal dust/gas mixture, which is supplied from a non-illustrated coal grinding plant or source of coal dust, is supplied to an elbow 11 that precedes the core air tube 6. In the elbow 11, a concentration of the coal dust on that side of the elbow that faces the combustion chamber is brought about. When viewed in the direction of flow, the elbow 11 first widens and then narrows, and on the whole has a cross-sectional contour that leads to a reduction in flow velocity. The reduced flow velocity also effects a reduction of the coal dust velocity. The retardation of the flow results in an at least partial separation of the coal dust/gas mixture in the elbow, as schematically illustrated in FIG. 2 by the coal dust arrow K and the gas flow arrow G.

The coal dust stratifications or "ropes" K in the elbow 11 strike a rope breaker 12 that is disposed on that wall of the elbow that faces the combustion chamber. The rope breaker 12 preferably comprises a plurality of offset breaker elements 13 that are disposed along a prescribed sector. The breaker elements are preferably spaced-apart rod-like elements that can be individually replaced.

As a consequence of the rope breaker 12, the coal dust ropes K that form can be separated into individual ropes. These individual ropes are picked up by the gas flow that is deflected by the rear wall 11*a* of the elbow 11 and, accompanied by essentially uniform distribution of the coal dust, are distributed to the entry cross-section of the annular channel 9.

In order to be able to vary the position of the entry of the core air into the primary air that exits the annular channel 9, an extension 14 of the core air tube 6 is provided that can be axially displaced along the burner axis by the oil lance 5.

Associated with the discharge end of the primary air tube 10 is a flame holder 15 that comprises a straight cylindrical portion 15*a* that overlaps the primary air tube 10, and an adjoining conically widening portion 15*b*. Near the discharge end of the widening portion 15*b* are radially extending, spaced-apart blocking teeth 16 that project into the primary flow and are uniformly circumferentially distributed. In place of individual blocking teeth, it might also be possible to use a blocking ring.

As shown by the dashed-line position in FIG. 1, the flame holder 15 is axially displaceably disposed on the primary air tube 10. Displacement is effected by a slide device 17 that is accessible from the outside.

The primary air tube 10 is surrounded by a secondary air tube 18. That end of the secondary air tube that faces the combustion chamber has a muffle 18*a*, followed by a straight cylindrical section 18*b* and a conically widening portion 18*c* from which an annular wall 18*d* extends perpendicularly relative to the burner axis. Disposed in the vicinity of the secondary air muffle 18*a*, in the channel 19, is a radiation protection shield 18*f* that is spaced from the inner wall of the muffle; air flows about the protection shield 18*f*.

The annular channel 19 is formed between the primary air tube 10 and the secondary air tube 18. A device 20 in the form of axial swirl vanes or flaps 21 for influencing the swirl of the secondary air is disposed in the annular channel 19.

Figures 3A, 3B:
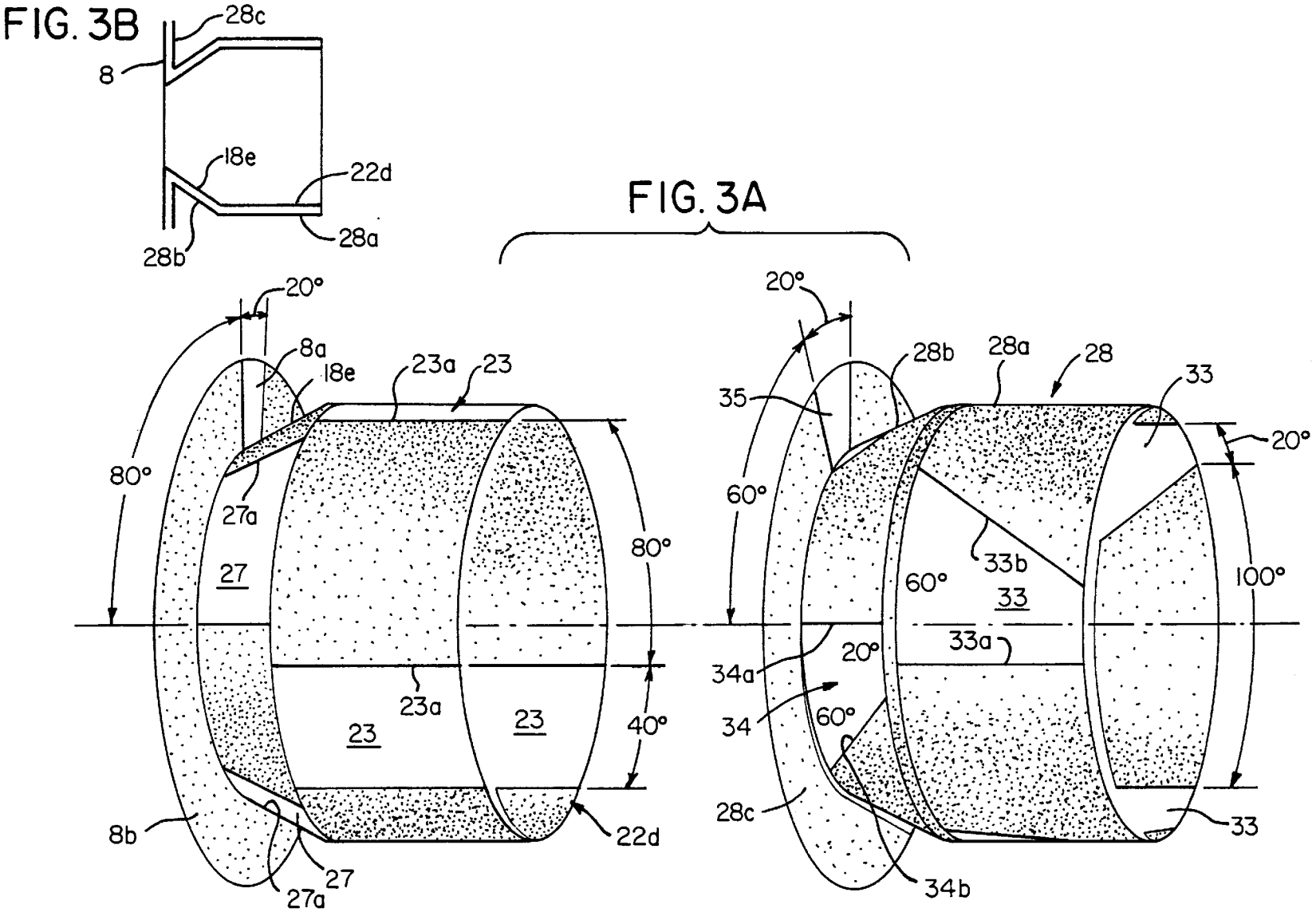
FIG. 3 is a schematic view of the air inlet portions for the secondary air channel and the tertiary air channel, as well as the core air channel and the arrangement of the air passage openings in the rotating damper arrangement.

A tertiary air tube 22 extends concentric to and is spaced from the secondary air tube 18 while forming a tertiary air channel 22'. Beginning at the combustion chamber wall 3, the tertiary air tube 22 comprises a straight cylindrical section 22*a*, a conically widening section 22*b*, an annular plate 22*c* that extends perpendicular to the burner axis, and a straight cylindrical tubular section 22*d*, the left end of which in FIG. 1 is closed off by the annular wall 18*d*. As can be seen in FIG. 3, there are provided in the straight cylindrical section 22*d* three air inlet or passage openings 23, the longitudinal edges 23*a* of which extend in an axis parallel manner. In the embodiment illustrated in FIG. 3, the circumferential angles of the air inlet openings 23 and the closed regions between the openings 23 have been indicated.

Adjoining the free end of the portion 22*a* of the tertiary air tube 22 is the stamped-out burner muffle 24 in the combustion chamber wall 3. Disposed in the conical portion 22*b* is a swirl device 25 that, as indicated by the dashed-line representation in FIG. 1, is axially displaceable. Such axial displacement is effected externally with the aid of the actuating device 26.

As shown in FIG. 1, the left end of the annular channel 19 widens in a radial direction. This widening is delimited by the inner surface of the burner mounting plate 8, the inner surface of the annular wall 18*d*, and by a frusto-conical plate 18*e* that on the one hand is connected to an edge of the annular wall 18*d* and on the other hand is connected to the burner mounting plate 8. The conical angle is such that the connection with the burner mounting plate 8 is disposed below the air inlet opening 8*a*; in particular, the connection is to the outer edge of the inwardly disposed part 8*c* of the burner mounting plate.

Provided in the frusto-conical plate 18*e* are three air inlet or passage openings 27, the longitudinal edges 27*a* of which are disposed in axial planes. The openings 27 are offset in a circumferential direction relative to the openings 23.

The left hand side of FIG. 3 schematically illustrates how the frusto-conical plate 18*e* adjoins the burner mounting plate 8 with its opening 8*a*; in particular, the outer annular portion 8*b* is shown, which is secured, for example, by screws to the inner annular part 8*c* that extends around the primary tube 10. The outer annular part 8*c* is secured to the side wall 4.

To control the air quantities that enter the air channels 6', 19 and 22' through the associated openings 23, 27 and 8*a*, a unitary rotating valve or damper 28 is associated with the sections 22*d*, 18*e* and the burner mounting plate 8. This rotating valve 28 comprises a straight cylindrical section 28*a*, a conical section 28*b*, and a radially extending section 28*c*. Provided on the free edge of the radially extending section 28*c* is a flange 29 that is provided, for example, with a toothed driven part 30 in which engages a pinion 31 that can be driven by an electric motor 32. In this way, the rotating valve 28 can be rotated.

The section 28*a* of the rotating valve 28 is provided with three air passage openings 33 for tertiary air in such a way that each opening has an axially extending edge 33*a* and an edge 33*b* that extends at an angle to the axis. Angular dimensions are indicated in FIG. 3.

Air passage openings 34 for secondary air are provided in the section 28*b* and are offset in the circumferential direction relative to the openings 33. The longitudinal edges 34*a* and 34*b* extend axially and at an angle to the burner axis respectively. The angular measurements are similarly indicated in FIG. 3. The longitudinal edges 33*b* and 34*b* are inclined in opposite directions.

Provided in the radial section 28*c* is an air passage opening 35 for core air. The longitudinal edges of the opening 8*a* and of the opening 35 extend radially.

At that end that is remote from the combustion chamber side wall 4, the rotating valve 28 of FIG. 1 is provided with a guide flange 28*d* that runs on rollers 36 that are disposed on an extension of the annular plate 22*c* beyond the cylindrical section 22*d*. Disposed between the section 22*a* and the insulated combustion chamber wall 3 is a seal means 37.

As can also be seen from FIG. 1, spacers 38 are provided to ensure that the individual tubes 6, 10, 18 and 22, and the radiation protection shield 18*f*, are properly spaced apart.

To detect the velocity or quantity of the secondary air, one or more pilot tubes 39 are provided. In addition to the drive pinion 31, support and guide pinions or wheels 40 are also uniformly distributed about the periphery of the flange 29.

In place of or in addition to the oil lance 5, gas lances can also be provided. As can be seen from FIG. 1, the core air tube 6 and the primary air tube 10 can have portions with different wall thicknesses and/or can be made of different materials.

During operation of the burner, for the primary flame it is desired to have a hot, greatly understoichiometric or oxygen-lean, compact primary combustion zone with as complete a pyrolysis of the fuel as possible and internal fuel staging. An air index of 0.3–0.6, preferably 0.4–0.5, should be realized in the primary flame. For this purpose, at the dust discharge end of the primary air tube 10 such a configuration is desired that on the one hand a staging of the fuel entry into the primary flame is achieved, and on the other hand a stable and rapid ignition of the coal dust is supported. For this purpose, it is desired to concentrate and retard the fine dust at the outer periphery of the dust discharge in order to ensure a rapid mixture with the peripheral air that is supplied via the peripheral air tube. The widening of the dust cross-sectional area in the channel section 15*b* effects a retardation of the gas flow and there results a velocity profile with a slower outwardly disposed flow and a more rapid inwardly disposed flow. At the same time, a separation of fine dust occurs, since this fine dust follows the widening more rapidly, i.e. the coal concentration in the region adjacent to the core air tube is greater than in the outer, slower flow, since the coarser coal particles maintain their flow direction. The blocking teeth 16 effect a further retardation of the dust in the outer region of the coal dust crosssectional area, and a turbulence of the flow that favors a transport of the fine dust toward the outside and hence the rapid mixture thereof into the peripheral air. The coarser dust is only relatively slightly retarded by the slower flow. This dust enters the core of the flame with a relatively high velocity. This ensures that as the size of the particles increases, a longer period of time is available for heating up and pyrolysis, and a delayed, continuous entry of fuel into the primary flame is effected. On the whole, a multiple staging of the fuel in the primary flame is achieved. The widening of the coal dust cross-sectional area additionally effects a flow dynamic separation of the peripheral air from the primary flow of coal dust, which similarly favors a staged fuel entry into the primary flame.

The secondary air is swirled in the prescribed manner by the swirl device 20. In so doing, the backflow zone for the primary flame is formed. The S-shaped configuration at the end of the secondary air tube 18 in the region of the secondary air muffle 18*a* prevents the primary flame from breaking up, even if a high swirl is imparted to the secondary air. The S-shape of the muffle leads to a nearly linear discharge of the secondary air and hence leads to a very compact primary flame having a small yet very intensive internal flue gas recirculation behind the flame holder 15.

The secondary air and the tertiary air are kept apart as long as possible by the secondary air muffle 18*a*. Since the tertiary air comprises approximately 60–70% of the entire combustion air, it is necessary to swirl the tertiary air with the aid of the swirl device 25. By shifting the swirl device, the ratio between swirled air, which flows through the swirl device 25, and non-swirled air, which flows past the swirl device 25, can be adjusted. The swirl device for the tertiary air is the same type of device as for the secondary air. The tertiary air forms a coherent layer of air about the primary flame and thus ensures complete combustion of all coal particles. For furnaces having separate top air supply an air index of 0.9–1.0 is adopted for the tertiary air, and where no separate top air supply is provided, an air index value of 1.15–1.2 is adopted.

With the burner described above, the supply of core air, secondary air and tertiary air is effected from the windbox 2. The individual air flows are established by adjusting the rotating valve 28.

Figure 4:
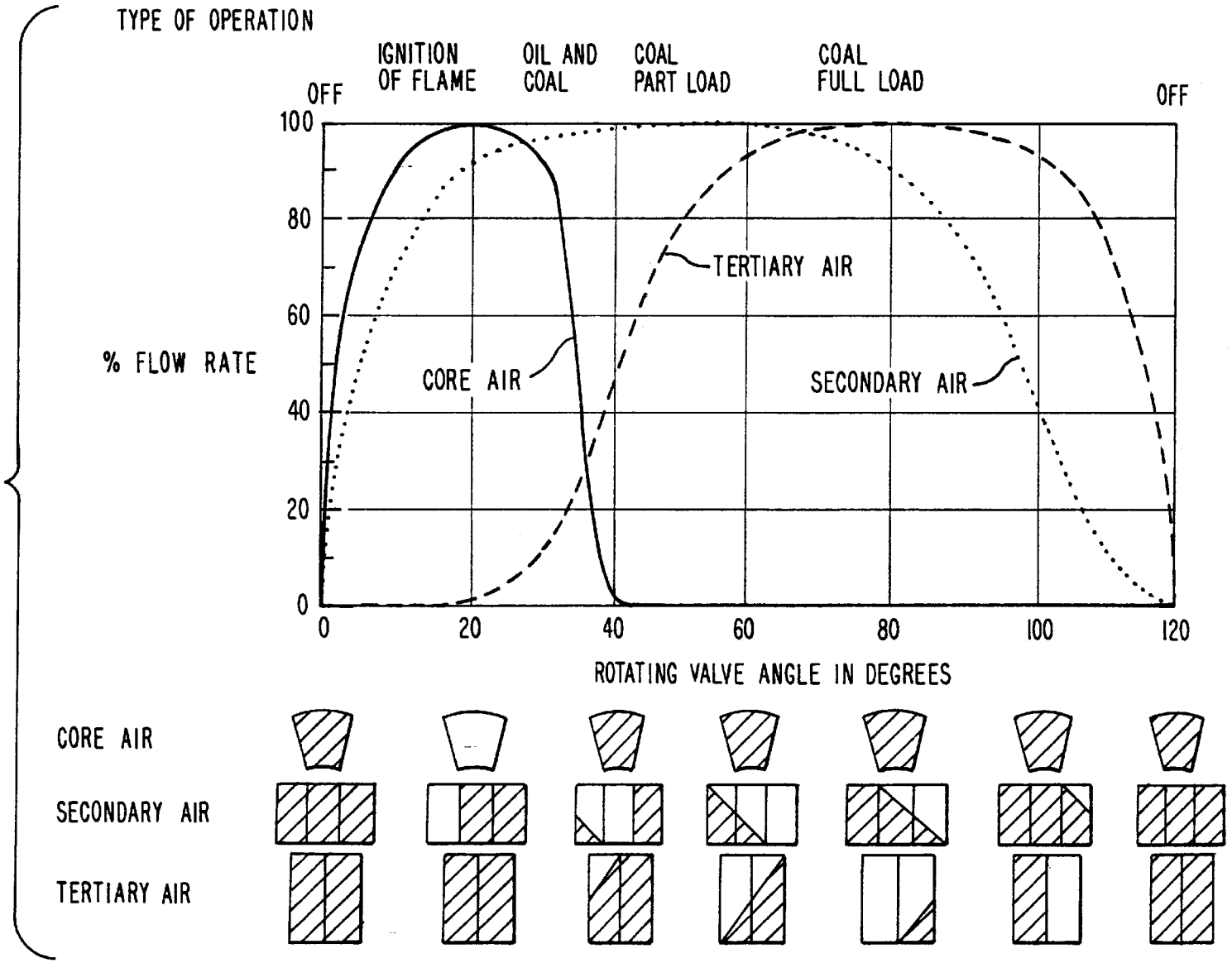
FIG. 4 is a schematic view of the supply of the burner with core air, secondary air and tertiary air as a function of the angular position of the rotating damper relative to the air inlet openings.

With respect to the illustrations of the operation of the rotating valve 28 as indicated in FIG. 4, three operating states of the burner will first be differentiated:

1. Off (the burner is not being operated and is in a cool position)
2. Ignition (operation of the burner with ignition fuel, oil or gas)
3. Operation under load (operation of the burner with coal).

If a simultaneous firing of oil/gas and coal or a higher burner output with oil/gas alone is required, a fourth position can also be provided for the rotating valve:

4. Oil operation (operation of the burner with ignition fuel and

If an excellent part load behavior is desired, a fifth position of the rotating valve can also be provided:

5. Operation at part load (the burner is operated with coal at part load).

With the aid of the single electric motor or actuator 32, the rotating valve can be rotated into one of the three to five positions as a function of the desired type of operation.

There is no need to continuously modulate the rotating valve over load.

To trim the air flow to the individual burners, which are operated from a common windbox, one or more pilot tubes 39 are provided. During operation, the positions of the rotating valve 28 are established as a function of the flows that are measured by the sensors.

FIG. 4 illustrates the air ratios for the aforementioned types of operation. The core air is indicated with a solid line, the secondary air is indicated by a dotted line, and the tertiary air is indicated by a dashed line. The illustrations at the bottom of FIG. 4 relate to the actual flow cross-sections of the individual inlet openings that result from the cooperation of the openings 8*a*/35, 27/34 and 23/33. The vertical lines in the illustrations of the lines "secondary air" and "tertiary air" represent the rotational intervals. In the illustrations at the bottom of FIG. 4, the open cross-sections are indicated in white and the covered cross-sections are indicated by crosshatching. The angular indications of FIGS. 3 and 4 are exemplary only.

The present invention is, of course, in no way restricted to the specific disclosure of the specification and drawings, but also encompasses any modifications within the scope of the appended claims.

What we claim is:

1. A burner for a furnace having at least one windbox that is supplied with air for combustion and has extending therethrough at least one such burner, opening out toward a combustion chamber, said burner comprising:

at least one primary air channel, which is supplied from the outside with a coal dust/air mixture;

at least one secondary air channel, which surrounds said primary air channel and, along a rotationally symmetrical portion of an outer surface thereof, is provided with at least one air inlet opening;

at least one tertiary air channel, which surrounds said secondary air channel and, along a rotationally symmetrical portion of an outer surface thereof, is provided with at least one air inlet opening; and means in the form of annular valve sections for regulating the supply of air from said windbox to said secondary and tertiary air channels, said annular valve sections being successively disposed one after the other as viewed in an axial direction of said burner, wherein each of said annular valve sections has at least one air passage opening and is respectively rotatably disposed about one of said secondary air channel and said tertiary air channel.

2. A burner according to claim 1, wherein said two annular valve sections are rigidly interconnected.

3. A burner according to claim 1, wherein said air inlet openings of said secondary and tertiary air channel portions, and said air passage openings in said annular valve sections, are respectively offset relative to one another in a circumferential direction.

4. A burner according to claim 1, said burner including air channel disposed in said primary air channel, and further includes an oil or gas lance that is disposed in said core air channel, wherein said core air channel is adapted to be supplied with air from said windbox by means of a core air connector channel that is disposed externally of said windbox.

5. A burner according to claim 1, wherein said annular valve section for tertiary air is a straight cylindrical annular valve section.

6. A burner according to claim 4, wherein said annular valve section for secondary air is a frusto-conical annular valve section having an end that is remote from said tertiary air valve section and on which is disposed a plate-like control valve section having an air passage opening for the passage of core air from said windbox into said core air connector channel.

7. A burner according to claim 1, wherein longitudinal edges of said air inlet openings of said secondary and tertiary air channels are disposed parallel to said axial direction of said burner, and wherein at least one edge of said air passage openings in said annular valve sections is disposed at an angle to said axial direction of said burner.

8. A burner according to claim 1, wherein an axially displaceable flame holder is disposed at a discharge end of said primary air channel, said flame holder comprising a straight cylindrical section adjoined by a conically widening section, wherein a blocking means is disposed at a discharge end of said conically widening section.

9. A burner according to claim 8, wherein a radiation shield is disposed between said conically widening section and a discharge portion of said secondary air channel, which discharge portion is embodied as a muffle, said radiation shield having a shape that is adapted to said conically widening portion and said muffle.

10. A burner according to claim 1, wherein an elbow is provided that is disposed at and upstream of an inlet of said primary air channel, and wherein a rope breaker is disposed within said elbow on a wall thereof at which is established a coal dust rope that is formed in said elbow upon deflection of said coal dust/air mixture that flows therethrough to said primary air channel.

* * * * *